US006230994B1

(12) United States Patent
Boerner et al.

(10) Patent No.: US 6,230,994 B1
(45) Date of Patent: May 15, 2001

(54) ROTARY ATOMIZING HEAD TYPE COATING DEVICE

(75) Inventors: Gunter Boerner, Muehlhausen; Gert Stauch, Wiesloch; Josef Wittmann, Hockenheim, all of (DE); Michio Mitsui, Yokohama; Kimiyoshi Nagai, Shimada, both of (JP)

(73) Assignees: Asea Brown Boveri AG, Heidelberg (DE); ABB K.K., Tokyo (JP)

( * ) Notice: Subject to any disclaimer, the term of this patent is extended or adjusted under 35 U.S.C. 154(b) by 0 days.

(21) Appl. No.: 09/581,168

(22) PCT Filed: Oct. 8, 1999

(86) PCT No.: PCT/JP99/05573

§ 371 Date: Jun. 13, 2000

§ 102(e) Date: Jun. 13, 2000

(87) PCT Pub. No.: WO00/21681

PCT Pub. Date: Apr. 20, 2000

(30) Foreign Application Priority Data

Oct. 13, 1998 (JP) ..... 10-306330

(51) Int. Cl.[7] ..... B05B 5/00

(52) U.S. Cl. ..... 239/700; 239/706; 239/701; 239/705; 118/620

(58) Field of Search ..... 239/700, 706, 239/707, 708, 701, 704, 705, 690, 690.1, 699, 223, 224, 214.25; 118/620, 621, 629

(56) References Cited

U.S. PATENT DOCUMENTS 4,576,827 * 3/1986 Hasting et al. .
5,622,563 * 4/1997 Howe et al. ..... 239/700
5,853,126 * 12/1998 Alexander ..... 239/700
6,076,751 * 6/2000 Austin et al ..... 239/700

FOREIGN PATENT DOCUMENTS 8-150352 * 6/1996 (JP) .
10-165848 * 6/1998 (JP) .

* cited by examiner

*Primary Examiner*—David A. Scherbel
*Assistant Examiner*—Dinh Q Nguyen
(74) *Attorney, Agent, or Firm*—Oblon, Spivak, McClelland, Maier & Neustadt, P.C.

(57) ABSTRACT

A rotary atomizing head type coating machine which is arranged to prevent occurrence of spark discharges, including a rotational shaft (9) which is formed of an insulating material, a rotary atomizing head (11) which is likewise formed of an insulating material and mounted on a fore end portion of the rotational shaft (9). An on-head semi-conductive coat film (14) is formed on outer peripheral surfaces of the rotary atomizing head (11). On the other hand, a first arcuate coat film (16) is formed on a first limiter ring (15) which is provided on a motor body (6), and a second arcuate coat film (18) is formed on a second limiter ring (17) which is provided on the rotary atomizing head (11). Further, a power supply semi-conductive coat film (19) is formed on and around outer peripheral surfaces of the rotational shaft (9) between the arcuate coat films (16) and (18). A high voltage which is applied to the air motor 5 is supplied to paint releasing edges (12E) of the rotary atomizing head (11) through the first arcuate coat film (16), power supply semi-conductive coat film (19), second arcuate coat film (18) and on-head semi-conductive coat film (14).

11 Claims, 8 Drawing Sheets

ROTARY ATOMIZING HEAD TYPE COATING DEVICE

TECHNICAL FIELD

This invention relates to a rotary atomizing head type coating machine which is adapted to atomize a paint into finely divided particles by high speed rotation of a rotary atomizing head, and more particularly to a rotary atomizing head type coating machine which is suitable for use as a direct charging type electrostatic coating machine which is adapted to apply a high voltage directly to paint.

BACKGROUND ART

Generally, rotary atomizing head type coating machines have been and are in wide use for coating vehicle bodies or similar coating objects. A rotary atomizing head type coating machine is largely constituted by a cover of a tubular shape, an air motor which is housed in the tubular cover, a hollow rotational shaft which is passed axially through and rotated by the air motor, a feed tube which is extended axially and internally of the hollow rotational shaft, and a rotary atomizing head which is mounted on the rotational shaft and put in high speed rotation to spray a paint which is supplied from the feed tube.

As for rotary atomizing head type coating machines, there have been known in the art the so-called direct charging type electrostatic coating machines which are arranged, for example, to apply a high voltage to the rotational shaft for electrically charging paint which flows through the feed tube (e.g., as disclosed in Japanese Laid-Open Patent Publication No. H2-237667, H6-269701 and H8-150352).

In the case of a rotary atomizing head type coating machine of this sort, the rotary atomizing head is formed of an insulating synthetic resin material, and a semi-conductive film layer is formed at and on paint releasing edges of the rotary atomizing head. A high voltage is applied to the semi-conductive film layer through a semi-conductive film, an electrode or the like which is provided in the proximity of the rotary atomizing head. As a result, corona discharge occurs at the fore end of the semi-conductive film layer of the rotary atomizing head, and aeroions are generated by aeroionization under the influence of the corona discharge. Therefore, the paint particles which are sprayed from the paint releasing edges of the rotary atomizing head are adsorbed on aeroions, which are generated in a corona discharge zone, to form charged paint particles. Consequently, charged paint particles which are sprayed from the rotary atomizing head are urged to fly along an electrostatic field toward and deposit on a coating object which is held at the earth potential.

Further, in the case of the prior art as described above, having the rotary atomizing head is formed of an insulating synthetic resin material, it becomes possible to lower the static capacity of the rotary atomizing head itself to a significant degree as compared with rotary atomizing heads which are formed of a metallic material. Therefore, even if a coating object comes to an abnormally close proximity to the rotary atomizing head, there is no possibility of accumulated charges on the rotary atomizing head instantly dischanging toward the coating object.

The prior art rotary atomizing head type coating machines according to the above-mentioned prior art employ a rotary atomizing head which is formed of an insulating synthetic resin material. Accordingly, when a coating object to be coated comes to an abnormally close proximity to the rotary atomizing head, there is little possibility that spark discharges generally referred to as "streamers" or "sparks" are induced solely by accumulated charges on the part of the rotary atomizing head. However, in the case of the above-mentioned prior art, the coating machine has metallic parts such as air motor, which have a floating capacitance and therefore can store electric charges therein. If electric charges are stored by the floating capacitance of the air motor or other metallic parts, spark discharges take place as a result of instant discharge of the stored electric charges to the coating object.

Therefore, it becomes necessary to prevent direct discharges from a metallic component such as air motor, for holding discharge energy below an ignition level. In this connection, discharge energy E can be expressed by Equation 1 below, wherein C is the electrostatic capacitance of a part holding electric charges to be discharged, and V is the voltage across the discharging part and a coating object.

$$E=\tfrac{1}{2}CV^2 \qquad \text{[Equation 1]}$$

Accordingly, in case a rotary atomizing head is formed of an insulating material, the energy of discharges from the rotary atomizing head itself can be suppressed to a low level because its electrostatic capacitance is small. However, in that case it is difficult to suppress discharges from an air motor which is located in the vicinity of the rotary atomizing head and which has a large electrostatic capacitance.

As a countermeasure for preventing discharges from the air motor, it is conceivable to increase the discharge distance between the air motor and a coating object by using a rotational shaft which is formed of an insulating material and relatively large in length. However, in the case of a rotational shaft of an increased length, it is very likely that fluttering occurs to the rotational shaft, thereby impairing mechanical stability of the air motor and shortening its service life to a considerable degree.

Discharges from the air motor can also be prevented, for example, by inserting a high resistance between the air motor and a high voltage generator in such a way as to lower the voltage to be applied to the air motor. However, a reduction in application voltage to the air motor will lead to a reduction in paint particle charging rate and as a result to a reduction in paint deposition efficiency.

Further, there has been a method of providing an anti-spark control circuit in a high voltage generator to prevent such spark discharges as would lead to ignition (e.g., as disclosed in Japanese Laid-Open Patent Publication No. H6-269701). However, a spark preventing method using a control circuit of this sort has a problem that it is not essentially useful for prevention of ignition, as clearly stipulated in Regulations by National Fire Preventing Association of the United States.

DISCLOSURE OF THE INVENTION

In view of the above-mentioned problems with the prior art, it is an object of the present invention to provide a rotary atomizing head type coating machine which is particularly so arranged as to prevent spark discharges between a rotary atomizing head and a coating object without lowering paint deposition efficiency.

According to the present invention, in order to solve the above-mentioned problems, there is provided a rotary atomizing head type coating machine which comprises: a cover of a tubular shape formed of an insulating synthetic resin material; an air motor mounted within the cover and formed of a conducting metallic material; a rotational shaft formed of an insulating material passed axially through and rotated by the air motor; a rotary atomizing head formed of an insulating synthetic resin material in a bell-like shape having a mounting portion at a rear end and paint releasing edges at a fore end thereof, and mounted on the rotational shaft at an axially spaced position from a fore end of the air motor; an on-head semi-conductive coat film provided on outer peripheral surfaces of the rotary atomizing head for charging paint particles to be sprayed from the rotary atomizing head; a power supply semi-conductive coat film provided either on inner peripheral surfaces of the cover or on outer peripheral surfaces of the rotational shaft between the fore end of the air motor and a rear end of the rotary atomizing head for supplying the rotary atomizing head with a high voltage applied to the air motor; a first arcuately curved portion formed in a ring-like shape by the use of an insulating synthetic resin material applied with a semi-conductive coat film on outer peripheral surfaces thereof or by the use of a conducting metallic material, and provided between the fore end of the air motor and the power supply semi-conductive coat film; and a second arcuately curved portion formed in a ring-like shape by the use of an insulating synthetic resin material applied with a semi-conductive coat film on outer peripheral surfaces thereof or by the use of a conducting metallic material, and provided between the power supply semi-conductive coat film and a rear end of the on-head semi-conductive coat film.

With the arrangements just described, a high voltage which is applied to the air motor is supplied to the on-head semi-conductive coat film on the rotary atomizing head of an electrically insulating material through the power supply semi-conductive coat film which is provided either on inner peripheral surfaces of the cover or on outer peripheral surfaces of the rotational shaft.

As soon as the rotary atomizing head is put in high speed rotation by the air motor along with the rotational shaft, paint is supplied to the rotary atomizing head to spray same forward from the paint releasing edges of the rotary atomizing head. At this time, corona discharges occur at the fore end of the on-head semi-conductive coat film, and aeroions which are produced by corona discharges are adsorbed on sprayed paint particles. As a result, charged paint particles are urged to fly toward and deposit on a coating object which is connected to the earth potential, traveling along an electric field which is formed between the rotary atomizing head and the coating object.

Further, since the rotational shaft is formed of an insulating material, it becomes possible to prevent short-circuiting between the rotational shaft and a coating object even when the rotary atomizing head is brought to an abnormally close proximity to the coating object.

Furthermore, the provision of the first arcuately curved portion between the fore distal end of the air motor and the power supply semi-conductive coat film, and of the second arcuately curved portion between the power supply semi-conductive coat film and the rear end of the on-head semi-conductive coat film makes it possible to prevent occurrence of spark discharges (streamer discharges) between the fore end of the air motor and the rear end of the rotary atomizing head, even when the rotary atomizing head comes to an abnormally close proximity to a coating object to permit a large current to flow from the air motor to the paint releasing edges.

In one preferred form of the present invention, the rotational shaft is formed of an insulating ceramic material.

This arrangement contributes to increase the mechanical strength of the rotational shaft to a significant degree as compared with a rotational shaft which is formed of a synthetic resin material in general or of a filler synthetic resin material or the like as disclosed in Japanese Laid-Open Patent Publication No. H6-269701. In addition, because of increased strength of electrical connection and lower moisture absorption of the rotational shaft, it becomes possible to prevent electrical discharges from the rotational shaft to a coating object, while increasing mechanical strength to prevent deformations of the rotational shaft which is put in high speed rotation during coating operations.

Further, according to the present invention, the first and second arcuately curved portions are formed to have arcuately curved surfaces of from 0.5 mm to 25 mm in radius of curvature.

This arrangement contributes to prevent concentration of an electric field effectively even when the rotary atomizing head is abruptly brought to an abnormally close proximity to a coating object, as compared with a case where the arcuately curved portions have a radius of curvature smaller than 0.5 mm. Consequently, an electric field is distributed in a dispersed way on each arcuately curved portion, and prevented from giving rise to spark discharges which might lead to ignition.

Further, according to the present invention, the first and second arcuately curved portions are spaced away from each other by a distance of from 10 mm to 80 mm.

With the arrangement just described, the first and second arcuately curved portions serve to moderate concentration of electric field at these portions, even when a coating object suddenly comes to an abnormally close proximity. As a result, electrical discharges from the air motor to the rotary atomizing head can be controlled to a moderate level.

Further, according to the present invention, the first arcuately curved portion is formed of an insulating synthetic resin material and applied with a semi-conductive coat film on outer peripheral surfaces thereof.

With the arrangement just described, a high voltage which is applied to the air motor is supplied to the power supply semi-conductive coat film through the semi-conductive coat film on outer peripheral surfaces of the first arcuately curved portion. At this time, the first arcuately curved portion which is in the shape of a doughnut serves to prevent concentration of electrical charges at the fore end of the air motor.

Further, according to the present invention, the second arcuately curved portion is formed of an insulating synthetic resin material and applied with a semi-conductive coat film on outer peripheral surfaces thereof.

With the arrangement just described, a high voltage which is applied to the air motor is supplied to the second arcuately curved portion through the power supply semi-conductive coat film. Then, through the second arcuately curved portion, the high voltage is supplied to the on-head semi-conductive coat film which is on the outer peripheral surfaces of the rotary atomizing head.

Further, according to the present invention, the first arcuately curved portion is formed of a conducting metallic material.

With the arrangement just described, a high voltage which is applied to the air motor is supplied to the power supply semi-conductive coat film on the inner periphery of the cover through the first arcuately curved portion. At this time, the first arcuately curved portion which is in the shape of a doughnut serves to prevent concentration of electric field at the fore end of the air motor.

Further, according to the present invention, the second arcuately curved portion is formed of a conducting metallic material.

With the arrangement juste described, a high voltage which is applied to the air motor is supplied to the second arcuately curved portion through the power supply semi-conductive coat film. Then, through the second arcuately curved portion, the high voltage is supplied to the semi-conductive coat film on the rotary atomizing head.

Further, according to the present invention, in case the power supply semi-conductive coat film is applied on and around inner peripheral surfaces of the cover, the first and second arcuately curved portions are formed of the same material as the cover and applied with a semi-conductive coat film on outer peripheral surfaces thereof.

With the arrangements just described, a high voltage which is applied to the air motor is supplied to the power supply semi-conductive coat film through the first arcuately curved portion, and then from the power supply semi-conductive coat film to the second arcuately curved portion. From the second arcuately curved portion, the high voltage is then supplied to the on-head semi-conductive coat film on the rotary atomizing head.

Further, according to the present invention, a power supply semi-conductive coat film is provided on outer peripheral surfaces of the rotational shaft, and an on-head semi-conductive coat film is provided on outer peripheral surfaces of a rotary atomizing head of an insulating synthetic resin material, while a first arcuately curved portion is provided at the fore end of the air motor and a second arcuately curved portion is provided on the side of a rear end portion of the on-head semi-conductive coat film.

Furthermore, according to the present invention, a power supply semi-conductive coat film is provided on inner peripheral surfaces of the cover, and an on-head semi-conductive coat film is provided on outer peripheral surfaces of the rotary atomizing head, while a first arcuately curved portion is provided at the fore end of the air motor, and a second arcuately curved portion is provided on the side of a rear end portion of the on-cup semi-conductive coat film.

BEST MODE FOR CARRYING OUT THE INVENTION

Hereafter, the present invention is described more particularly by way of its preferred embodiments with reference to FIGS. 1 through 8.

Figure 1:
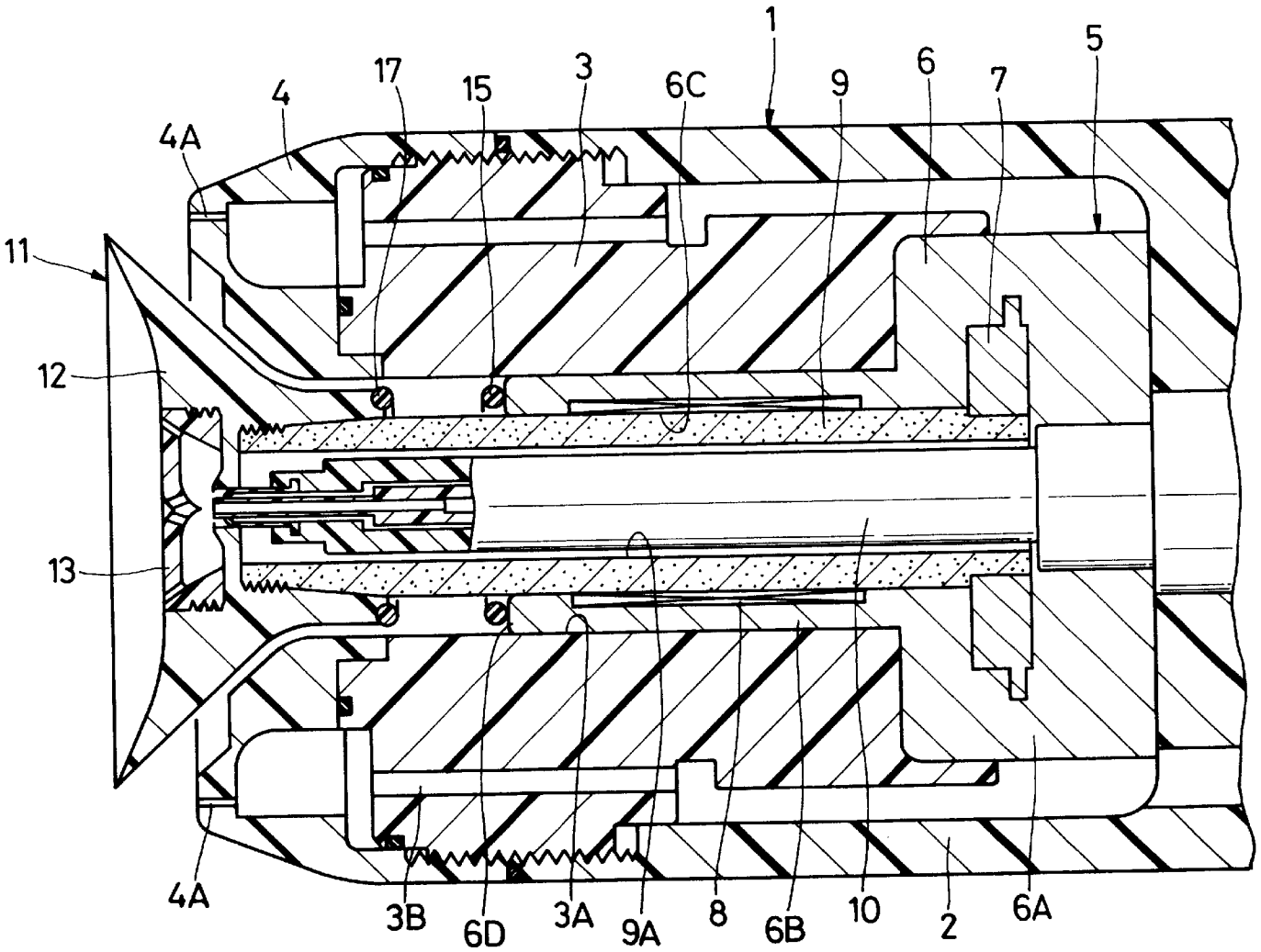
FIG. 1 is a schematic vertical section of a rotary atomizing head type coating machine, adopted as a first embodiment of the present invention.
Figure 2:
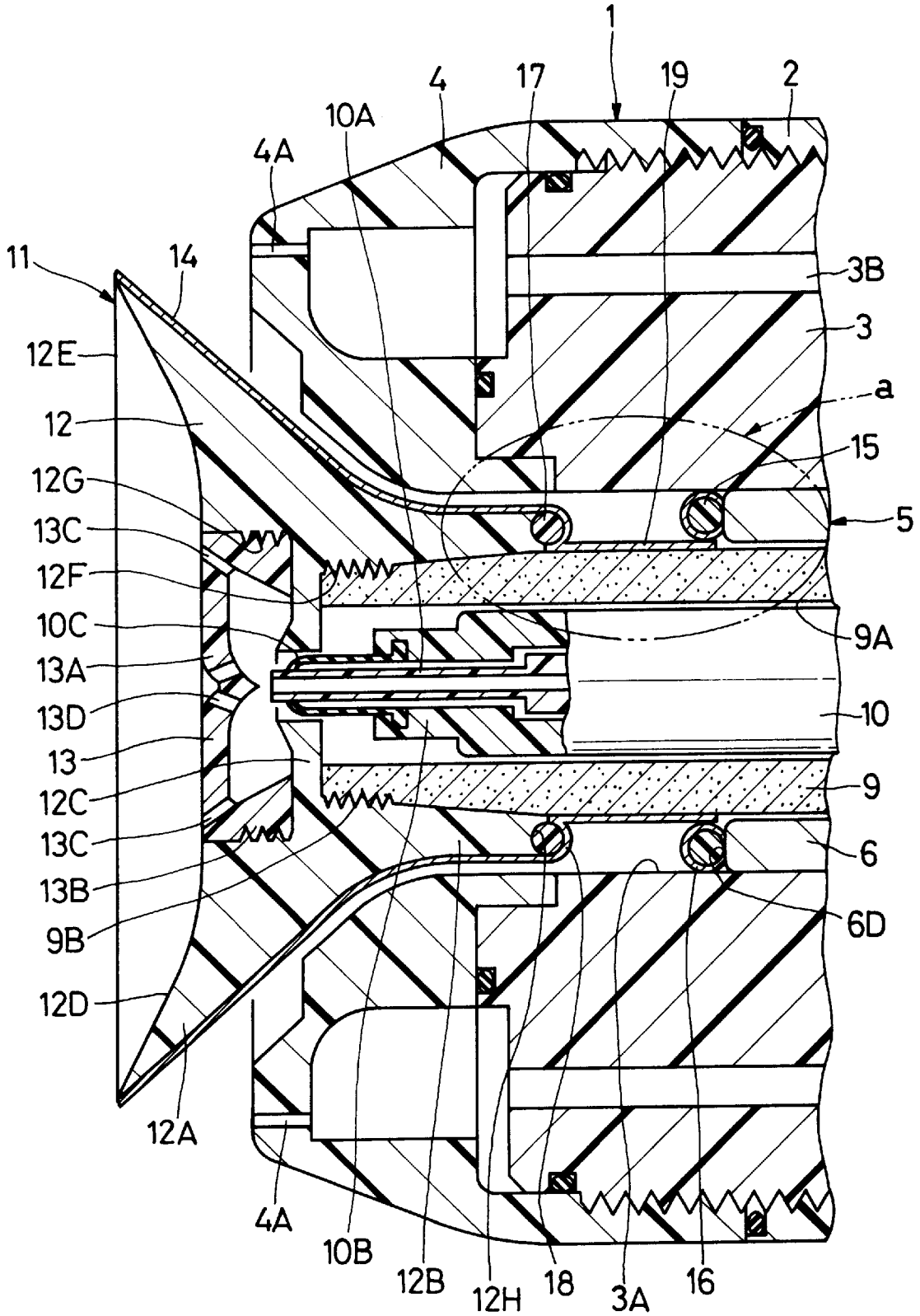
FIG. 2 is a schematic vertical section, showing major component parts of the rotary atomizing head type coating machine of FIG. 1.
Figure 3:
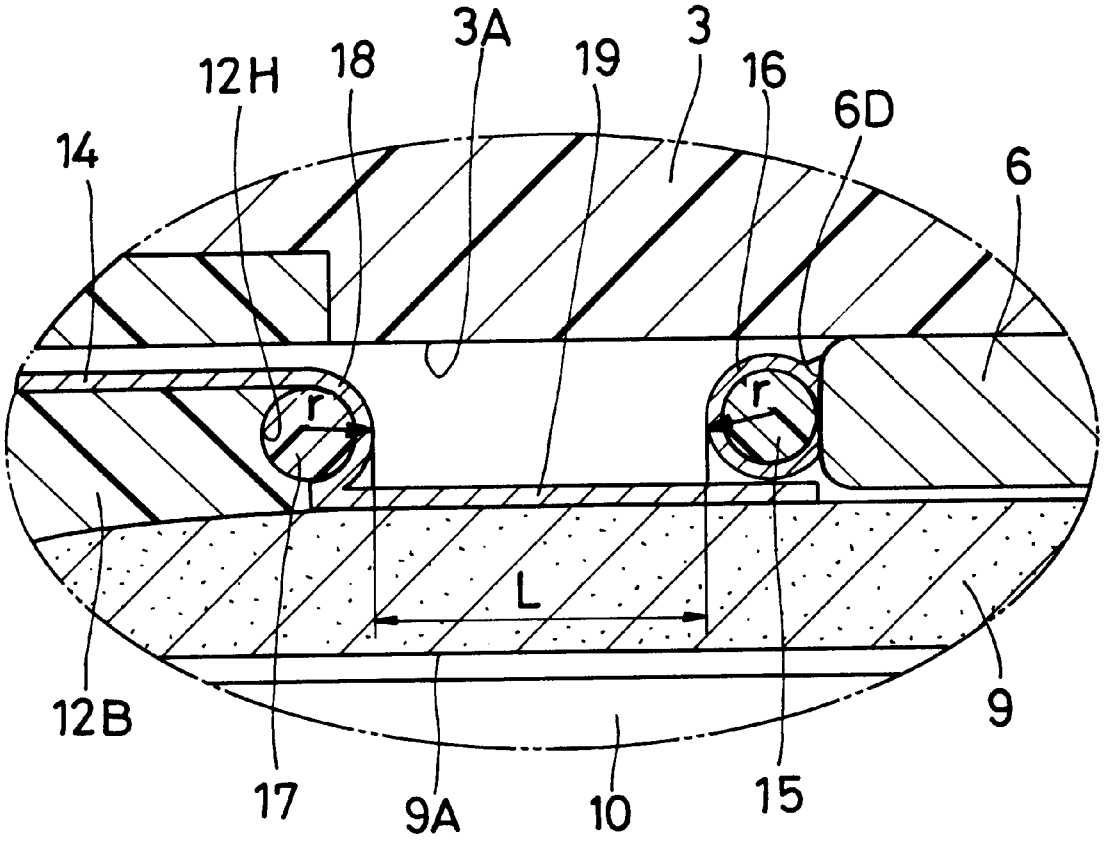
FIG. 3 is a schematic vertical section, showing on an enlarged scale an encircled portion a in FIG. 2.

Referring first to FIGS. 1 to 3, there is shown a rotary atomizing head type coating machine according to a first embodiment of the present invention.

In these figures, indicated at 1 is a cover which determines the outer configuration of the rotary atomizing head type coating machine. The cover 1 is constituted by a cover tube 2 which is formed substantially in a cylindrical shape, a motor support case 3, and a shaping air ring 4.

In this instance, the motor support case 3 is formed in the shape of a thick cylindrical tube and securely attached to the inner periphery of the cover tube 2. The motor support case 3 is provided with a stepped hollow support cavity 3A to support an air motor 5 which will be described hereinafter. Bored around the hollow support cavity 3A are shaping air passages 3B which are extended in the axial direction.

The shaping air ring 4 is attached to the front side of the motor support case 3, and has air outlet holes 4A arranged annularly on the front side thereof. Shaping air is supplied to each one of the air outlet holes 4A through the shaping air passages 3B.

For instance, the cover tube 2, motor support case 3 and shaping air ring 4 are formed of an insulating synthetic resin material such as polytetrafluoroethylene (PTFE), polyethylene terephthalate (PET) or the like.

Indicated at 5 is an air motor which is mounted within the hollow support cavity 3A of the motor support case 3. The air motor 5 includes a motor body 6 which is formed of a conductive metallic material in a stepped cylindrical shape, an air turbine 7 which is accommodated in the motor body 6, and a static air bearing 8 which rotatably supports a rotational shaft 9 as will be described hereinafter.

The motor body 6 is constituted by a turbine receptacle portion 6A of a larger diameter which accommodates the air turbine 7 therein, and an air bearing receptacle portion 6B of a smaller diameter which is extended axially forward from the turbine receptacle portion 6A. The static air bearing 8 is provided on and around the inner periphery of the air bearing receptacle portion 6B. Further provided in the motor body 6 is a hollow bore 6C which is extended forward from the turbine receptacle portion 6A and across the air bearing portion 6B to receive a rotational shaft 9 therein.

Further, for example, a high voltage between −60 kv and −120 kv is applied to the motor body 6 from a high voltage generator (not shown). The motor body 6 is fitted in the hollow support cavity 3A, and the rotational shaft 9 which is projected from the motor body 6 is positioned forward of a fore distal end of the hollow support cavity 3A.

The rotational shaft 9 is formed, for example, of a hard ceramic material or the like, and passed axially through the motor body 6 and supported by the static air bearing 8 in such a way as to permit high speed rotation therein. Provided internally of the hollow rotational shaft 9 is an axially extending bore 9A to receive therein a feed tube 10 which will be described after. Proximal base end of the rotational shaft 9 is securely fixed to the air turbine 7 of the air motor 5, while its fore end is projected forward of the motor body 6. Formed on a fore end portion of the rotational shaft 9 is a male screw portion 9B for threaded engagement with a female screw portion 12F of a rotary atomizing head body 12 which will be described after.

Denoted at 10 is the feed tube which is extended axially through the internal bore 9A of the rotational shaft 9 and the fore end of the feed tube 10 is projected from the rotational shaft 9 and extended into the rotary atomizing head 11 to supply paint or thinner to the rotary atomizing head 11. The feed tube 10 is constituted by a double wall tube, providing a paint passage within an inner tube 10A and a thinner passage between the inner tube 10A and an outer tube 10B. A check valve 10C formed a rubber or the like is attached to the fore end of the outer tube 10B to prevent thinner from dripping off the feed tube 10.

For instance, the feed tube 10 is formed of an insulating synthetic resin material such as polyether sulfone (PES), polyphenylene sulfide (PPS), polyether imide (PEI), polyether ether ketone (PEEK), polyoxymethylene (POM), polyamide imide (PAI), polyethylene terephthalate (PET), polyimide (PI) and the like.

Indicated at 11 is the above-mentioned rotary atomizing head, which is of the bell-, cup- or saucer-type and mounted on the rotational shaft 9 on the front side of the shaping air ring 4. This rotary atomizing head 11 is constituted by an atomizing head body 12 and a hub member 13.

In this instance, the atomizing head body 12 which determines the configuration of the rotary atomizing head 11 is formed of an insulating synthetic resin material, for example, polyether sulfone (PES), polyphenylene sulfide (PPS), polyether imide (PEI), polyether ether ketone (PEEK), polyoxymethylene (POM), polyamide imide (PAI), polyethylene terephthalate (PET), polyimide (PI) or the like, and formed in a bell-shape which is diverged in the forward direction.

The atomizing head body 12 is largely constituted by a forwardly diverging bell cup portion 12A, a cylindrical mounting portion 12B which is extended out on the rear side of the bell cup portion 12A, an annular partition wall 12C which is located behind the above-mentioned hub member 13 and projected radially inward between the bell cup portion 12A and the mounting portion 12B, a paint spreading surface 12D which is formed on the front side of the bell cup portion 12A forward of the hub member 13 to spread a paint into a thin film, paint releasing edges 12E which is provided at the front end of the bell cup portion 12A to release a paint therefrom in the form of liquid threads, a female screw portion 12F which is provided on the inner peripheral side of the mounting portion 12B for threaded engagement with the above-mentioned male screw portion 9B on the part of the rotational shaft 9, a stepped or recessed hub mounting portion 12G into which the hub member 13 is threaded, and an annular groove 12H which is formed on a rear end face of the mounting portion 12B substantially in a semi-circular arcuate shape in section.

On the other hand, the hub member 13 which is threaded into the stepped hub mounting portion 12G of the bell head 12A is formed of an insulating synthetic resin material similar to the atomizing head body 12, and constituted by a circular disk portion 13A and a cylindrical body portion 13B which is axially extended to the rear side of the circular disk portion 13A. Formed around the circumference of the circular disk portion 13A of the hub member 13, which adjoins the fore end of the cylindrical body portion 13B, are a large number of first hub holes 13C which serve as paint outlet holes for guiding a paint or thinner from the feed tube 10 toward the paint spreading surface 12D of the atomizing head body 12. Formed in center portions of the circular disk 13A are a plural number of second hub holes 13D (only two of which are shown in the drawings) which serve as thinner outlet holes which supplies thinner to the front side of the atomizing head.

A fore end portion of the rotational shaft 9 is fitted into the mounting portion 12B of the atomizing head body 12 and the female screw portion 12F on the part of the atomizing head 12 is threadedly engaged with the male screw portion 9B on the part of the rotational shaft 9. Consequently, the rotary atomizing head 11 is securely mounted on the rotational shaft 9. Further, the rear end face of the mounting portion 12B of the atomizing head body 12 (i.e., the surface with the annular groove 12H) is spaced from the fore end face 6D of the air bearing 6B constituting the motor body 6, for example, at a distance in the range of 10 mm to 80 mm.

Indicated at 14 is an on-head semi-conductive coat film which is applied on outer peripheral surfaces of the rotary atomizing head 11. This on-head semi-conductive coat film 14 is formed by applying a synthetic resin material such as polyester, epoxy resin, fluorine resin or the like into which carbon fiber or other metallic or conductive fiber is kneaded. The on-head semi-conductive coat film 14 is formed on outer peripheral surfaces between the rear end of the mounting portion 12B to the paint releasing edges 12E of the atomizing head body 12. More particularly, in rear end portions on the side of the mounting portion 12B, the semi-conductive coat film 14 is held in contact with an arcuate second coat film 18 on the circumference of a limiter ring 17 which will be described hereinafter, and, in fore end portions on the side of the paint releasing edges 12E, the on-head semi-conductive coat film 14 is allowed to contact the paint to be released from the paint releasing edges 12E.

Including the semi-conductive coat film 14, for example, the rotary atomizing head 11 is arranged to have a electrostatic capacitance which is smaller than 0.059 pF. As a consequence, the electrostatic charge build-up on the rotary atomizing head 11 can be held to a level which is low enough to prevent occurrence of spark discharges between the rotary atomizing head 11 and a coating object.

Indicated at 15 is the first limiter ring which forms a first arcuately curved portion at the fore end of the air motor 5. The limiter ring 15 is formed in a circular ring-like shape in section by the use of an insulating synthetic resin material similar to the atomizing head body 12, and securely fixed to a fore end face 6D of the motor body 6. A first arcuate coat film 16 is formed on the outer periphery of the limiter ring 15. Similarly to the on-head semi-conductive coat film 14 on the atomizing head, the first arcuate coat film 16 is formed by application of a synthetic resin material such as polyester, epoxy resin, fluorine resin or the like into which conductive fiber is kneaded, and located in a position intermediate between the air motor 5 and a power supply semi-conductive coat film 19 which will be described hereinafter. Further, including the arcuate coat film 16, the surface of the first limiter ring 15 is arranged to have a radius of curvature of approximately 0.5 mm to 25 mm.

Denoted at 17 is a second limiter ring which is provided at the rear end of the rotary atomizing head 11 as a second arcuately curved portion. Substantially similarly to the first limiter ring 15, the second limiter ring 17 is formed in a circular ring-like shape in section by the use of an insulating synthetic resin material, and fitted in an annular groove 12H which is formed on a rear end face of the mounting portion 12B of the atomizing head body 12. Formed on surfaces of the limiter ring 17 is a second arcuate coat film 18 as a second arcuately curved portion. The second arcuate coat film 18 is formed by application of a semi-conductive film similarly to the first arcuate coat film 16, and located between and electrically connected to the semi-conductive coat film 14 on the atomizer body and the semi-conductive coat film 19 for the power supply which will be described hereinafter.

The first and second limiter rings 15 and 16 are spaced away from each other, by a distance L in the range of 10 mm to 80 mm, for example about 50 mm. Further, including the arcuate coat film 18, the surface of the second limiter ring 17 is formed to have a radius of curvature of approximately 0.5 mm to 25 mm.

Indicated at 19 is the power supply semi-conductive coat film which is applied on outer peripheral surfaces of the rotational shaft 9. This power supply semi-conductive coat film 19 is formed by application of a synthetic resin material such as polyester, epoxy resin, fluorine resin or the like into which carbon fiber or metallic or other conductive fiber is kneaded, similarly to the second arcuate coat film 18. Further, the power supply semi-conductive coat film 19 is located between the fore end of the motor body 6 and the rear end of the mounting portion 12B, and held in contact with the arcuate coat film 18 at its fore end.

Further, the rear end of the power supply conductive coat film 19 is located in the vicinity of the motor body 6, more specifically, located in such small gap relation with the fore end face 6D of the motor body 6 as to permit air discharge thereacross. Therefore, the power supply semi-conductive coat film 19 is electrically connected with the first arcuate coat film 16 through a small gap, and, as the rotational shaft 9 is put in high speed rotation, the power supply semi-conductive coat film 19 is kept out of direct contact with the motor body 6 to prevent its frictional wear.

Accordingly, the first arcuate coat film 16, power supply semi-conductive coat film 19, second arcuate coat film 18 and the semi-conductive coat film 19 on the atomizing head are electrically connected with each other between the air motor 5 and the rotary atomizing head 11. It follows that a high voltage which is applied to the motor body 6 is supplied to the paint releasing edges 12E of the rotary atomizing head 11 via the first arcuate coat film 16, power supply semi-conductive coat film 19, second arcuate coat film 18 and onhead semi-conductive coat film 14.

Further, resistance values of the first arcuate coat film 16, power supply semi-conductive coat film 19, second arcuate semi-conductive coat film 18 and on-head semi-conductive coat film 14 are determined arbitrarily in such a way that the resistance between the fore end face 6D of the motor body 6 and the paint releasing edges 12E of the rotary atomizing head 11 falls in a range of 20 MΩ to 100 MΩ. With these arrangements, when the paint releasing edges 12E of the rotary atomizing head 11 come into contact with a coating object, the voltage on the side of the paint releasing edges 12E is dropped due to voltage reductions which take place through the first arcuate coat film 16, power supply semi-conductive coat film 19, second arcuate coat film 18 and the on-head semi-conductive coat film 14 to prevent occurrence of spark discharges between the rotary atomizing head 11 and the coating object.

The rotary atomizing head type coating machine with the above-described arrangements according to the present embodiment is operated in the manner as described below.

In case the coating machine is used for coating a vehicle body or the like, for example, air is supplied to the air motor 5 in the first place, actuating the air turbine 7 to put the rotary atomizing head 11 in high speed rotation along with the rotational shaft 9. In this state, paint is supplied to the feed tube 10 and then to the rotary atomizing head 11 from the feed tube 10.

As a result, the paint which has been supplied to the rotary atomizing head 11 is allowed to flow out onto the paint spreading surface 12D on the atomizing head body 12 through the hub holes 13C of the hub member 13 and spread into the shape of a thin film, and released forward in the form of atomized paint particles from the paint releasing edges 12E. In this instance, the high voltage which is applied to the motor body 6 of the air motor 5 is supplied to the rotary atomizing head 11 through the first arcuate coat film 16, power supply semi-conductive coat film 19, second arcuate coat film 18 and on-head semi-conductive coat film 14.

At this time, corona discharge takes place on the side of the paint releasing edges 12E at the fore end of the semi-conductive coat film 14 on the rotary atomizing head 11, and, for example, negative ion is produced in case a negative electric field is formed in the vicinity of the on-head semi-conductive coat film 14. After being sprayed from the paint releasing edges 12E of the rotary atomizing head 11, paint particles come into contact with the on-head semi-conductive coat film 14 and as a result the surfaces of paint particles are imparted with the opposite potential by inductive polarization. That is to say, in case of a negative electric field, the surfaces of paint particles are imparted with a positive potential. Therefore, as paint particles are sprayed from the paint releasing edges 12E, negative aeroions which are generated in a corona discharge region are adsorbed on the sprayed paint particles to negatively charge the same.

As a consequence, paint particles which are sprayed by the rotary atomizing head 11 are turned into charged paint particles, and undergo further atomization in shaping air streams which are spurted out through the air outlet holes 4A and put on flight toward a coating object which is connected to the earth potential, traveling along an electrostatic field which is formed between the rotary atomizing head and the coating object.

Thus, the rotary atomizing head type coating machine of the present embodiment can spray coating objects substantially in the same manner as prior art counterparts. However, according to the present embodiment, the rotary atomizing head 11 is formed of an insulating synthetic resin material and provided with the on-head semi-conductive coat film 14 on its outer periphery. Therefore, even if the coating machine is abruptly brought to an abnormally close proximity to a coating object during a coating operation (a near miss), the discharge energy E can be suppressed to a low level as the floating capacitance of the air motor 5 is converted into distributed capacitance by resistance of the on-head semi-conductive coat film 14 and other associated parts. Therefore, spark discharge would not occur even in the event of short circuiting due to a near miss or a contact with a coating object by the rotary atomizing head 11.

Besides, since the rotational shaft 9 and feed tube 10 are formed of an insulating material, the arrangements of the present embodiment contribute to preclude the possibility of short circuiting between the rotational shaft 9 and a coating object, even when the rotary atomizing head 11 is brought to an abnormally close to the coating object, thereby enhancing the safety and reliability of operation.

More specifically, in case the rotational shaft 9 and feed tube 10 are formed of a conducting metallic material, it is very probable that an approach to abnormal nearness to a coating object by the rotary atomizing head 11 results in spark discharge between the rotational shaft 9 and the coating object across the second hub holes 13D of the hub member 13. However, spark discharge toward a coating object from the rotational shaft 9 would not occur in the case of the present embodiment where the rotational shaft 9 as well as the feed tube 10 is formed of an insulating material.

On the other hand, when the rotary atomizing head 11 approaches to an abnormally close proximity to a coating object abruptly, it is generally observed that there is a tendency of an electric field concentrating on the fore end face 6D of the motor body 6 and the rear end face of the mounting portion 12B which are usually shaped in a relatively projected form, thereby giving rise to spark discharge which might lead to ignition. However, in the case of the present embodiment of the invention, the first and second limiter rings 15 and 17 of doughnut-like shapes which are covered with the arcuate coat films 16 and 18 are provided on the fore end face 6D of the motor body 6 and on the rear end face of the mounting portion 12B of the rotary atomizing head body 12, respectively.

Therefore, in case the rotary atomizing head 11 abruptly comes to an abnormally close proximity to a coating object, the electric field is dispersed over the curved surface of the arcuate coat film 16 on the first limiter ring 15. Similarly, on the arcuate coat film 18 on the second limiter ring 17, the electric field is dispersed over its curved surface. Namely, the first limiter ring 15 functions to moderate the concentration of electric field on the fore end face 6D of the air motor 5, while the second limiter ring 17 functions to moderate concentration of electric field at the rear end of the rotary atomizing head 11.

It follows that electrical breakdown hardly occurs between the fore end face 6D of the motor body 6 and the rear end face of the mounting portion 12B. Therefore, it becomes possible to prevent occurrences of ignition by spark discharges between the fore end of the air motor 5 and the rear end of the rotary atomizing head 11, which would cause damages to the rotary atomizing head 11 and other component parts.

Besides, according to the present embodiment, the high voltage on the side of the air motor 5 can be smoothly supplied to the rotary atomizing head 11 through the first arcuate coat film 16, power supply semi-conductive coat film 19, second arcuate coat film 18 and on-head semi-conductive coat film 14. Therefore, the high voltage to be supplied to the paint releasing edges 12E of the rotary atomizing head 11 can be dropped in a reliable manner through the first arcuate coat film 16, power supply semi-conductive coat film 19, second arcuate coat film 18 and on-head semi-conductive coat film 14, thereby precluding the possibilities of spark discharges occurring between the rotary atomizing head 11 and a coating object even when the rotary atomizing head 11 is abruptly brought to a close proximity to the coating object.

Further, according to the present embodiment, in case a large current flows toward a coating object from the paint releasing edges 12E of the rotary atomizing head 11, the high voltage on the side of the paint releasing edges 12E of the rotary atomizing head 11 can be dropped in a secure and reliable manner through the first arcuate coat film 16, power supply semi-conductive coat film 19, second arcuate coat film 18 and on-head semi-conductive coat film 14. Therefore, when the rotary atomizing head 11 is in operation for spraying a coating object from a distance of about 30 cm, for example, almost no current flows between the rotary atomizing head 11 and the coating object. This means that it is possible to maintain a high deposition rate since no drops occur to the high voltage to be supplied to the rotary atomizing head 11.

On the other hand, when the rotary atomizing head 11 comes to an abnormally close proximity to a coating object, a large current flows from the rotary atomizing head 11 to the coating object, and as a result the voltage on the side of the paint releasing edges 12E of the rotary atomizing head 11 is dropped through the power supply semi-conductive coat film 19 and other parts in the path of the current flow to prevent occurrence of spark discharges between the rotary atomizing head 11 and the coating object. This contributes to enhance the safety of operation all the more.

Further, since the rotational shaft 9 is formed of insulating ceramic material, it has higher mechanical strengths as compared with rotational shafts which are made of either an ordinary synthetic resin material or a filler synthetic resin material. This makes it possible to prevent deformations of the rotational shaft 9 which is put in high speed rotation during operation, and therefore to improve the reliability of the air motor 5. In addition, electrical insulation strength of the rotational shaft 9 can be enhanced by reduction of moisture absorption, for the purpose of preventing electric charges accumulated on the air motor 5 form being discharged instantly to a coating object through the rotational shaft 9.

Further, the limiter rings 15 and 17, including the respective arcuate coat films 16 and 18, are arranged to have a radius of curvature of about 0.5 mm to 25 mm. Therefore, even in case the rotary atomizing head 11 is abruptly brought to a close proximity to a coating object, they can prevent concentration of electric field on the fore end face 6D of the air motor 5 and on the rear end of the rotary atomizing head 11 far more effectively than in a case where the radius of curvature r is smaller than 0.5 mm. This arrangement contributes to moderate concentration of an electric field by distributing same in a dispersed fashion over the arcuate coat films 16 and 18 on the curved surfaces of the limiter rings 15 and 17, respectively. Besides, as compared with a case where the radius of curvature r is larger than 25 mm, it becomes possible to minimize the diameter of the cover 1 and to downsize the coating machine itself to a significant degree.

Further, the first and second limiter rings 15 and 17 are spaced away from each other by a distance in the range of 10 mm to 80 mm. Therefore, even when the rotary atomizing head 11 is brought to an abnormally close proximity to a coating object abruptly, the first and second limiter rings 15 and 17 can function to moderate concentration of electric field more effectively than in a case where they are located at a smaller distance from each other, i.e., at a distance smaller than 10 mm. Therefore, in the event of electrical discharge form the air motor 5 to the rotary atomizing head 11, if any, it can be controlled to a moderate level to prevent occurrence of spark discharges. In addition, as compared with a case where the first and second limiter rings 15 and 17 are located at a distance farther than 80 mm from each other, it becomes possible to downsize the coating machine itself.

Figure 4:
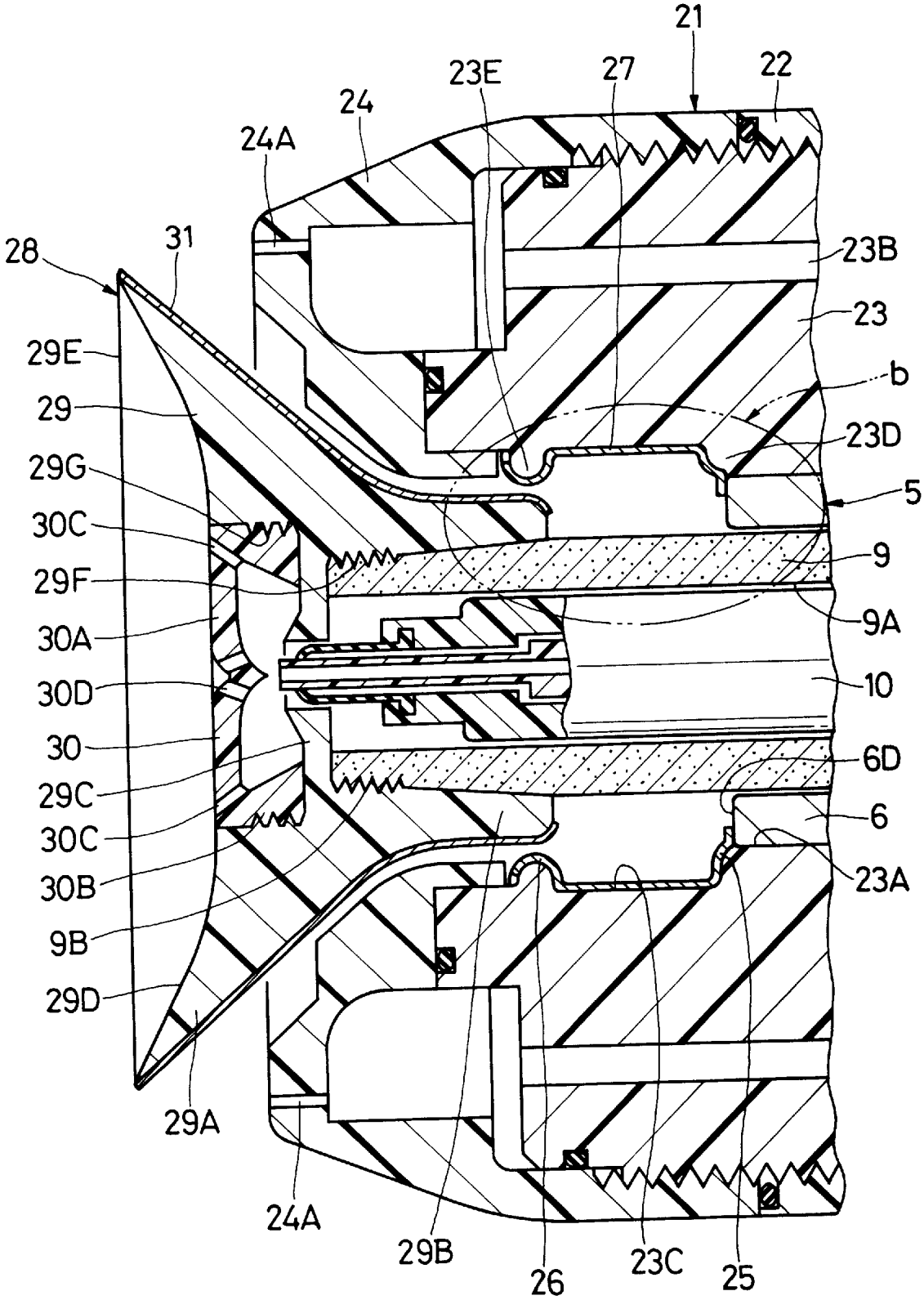
FIG. 4 is a schematic vertical section, showing major component parts of another rotary atomizing head type coating machine adopted as a second embodiment of the present invention.
Figure 5:
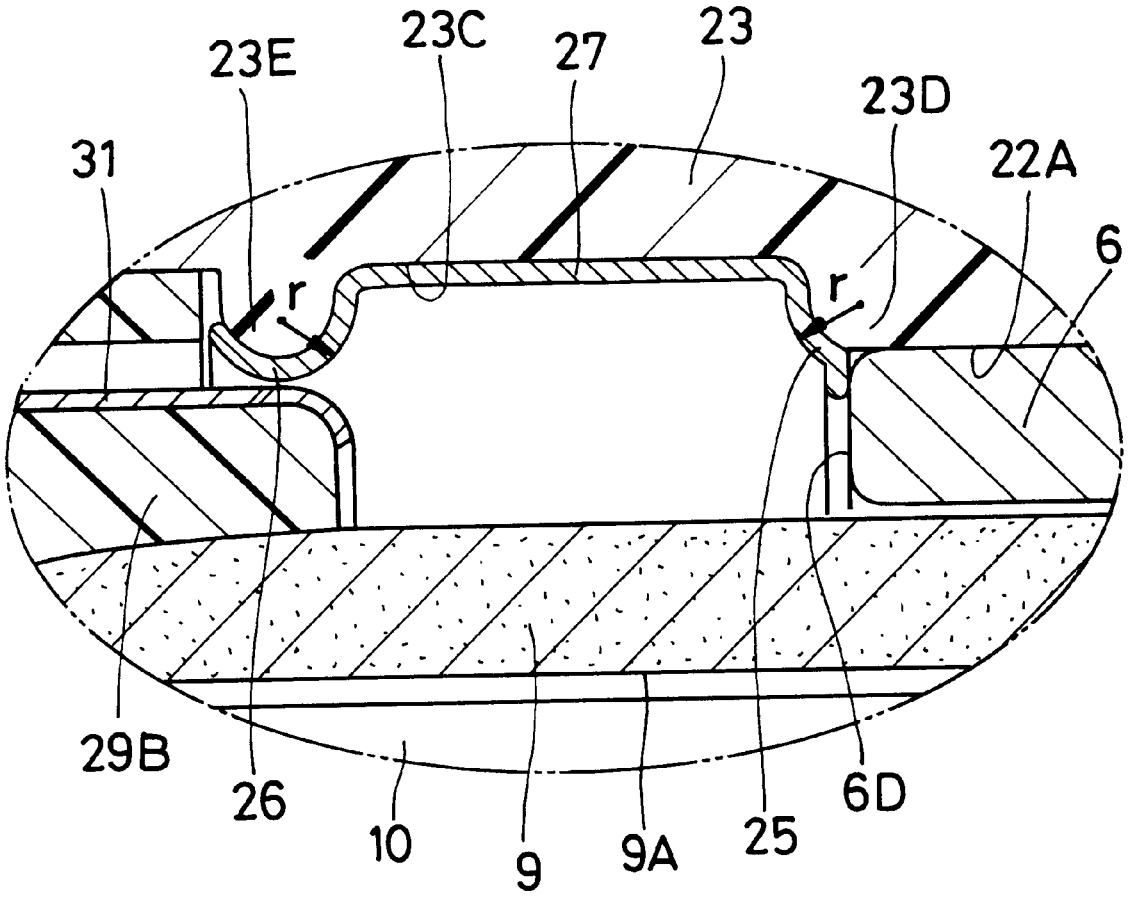
FIG. 5 is a schematic section, showing on an enlarged scale an encircled portion b in FIG. 4.

Now, turning to FIGS. 4 and 5, there is shown a second embodiment of the present invention. This second embodiment has a feature in that a power supply semi-conductive coat film is provided on the inner periphery of the cover. In the following description of the second embodiment, those component parts which are common with the foregoing first embodiment are designated by common reference numerals or characters to avoid repetitions of same explanations.

Indicated at 21 is a cover which determines the outer configuration of the rotary atomizing head type coating machine. The cover 21 is constituted by a cover tube 22 which is formed substantially in a cylindrical shape, a motor support case 23, and a shaping air ring 24.

Similarly to the motor support case 3 of the foregoing first embodiment, the motor support case 23 is generally in the shape of a thick-walled cylinder formed of an insulating synthetic resin material. Bored into or through the support case 23 are a hollow support cavity 23A and a shaping air passage 23B. However, this motor support case 23 differs from the motor support case 3 of the first embodiment in that an annular groove 23C is formed internally around a fore end portion of the hollow support cavity 23A.

Further, first and second arcuately protruding ridge portions 23D and 23E are formed around axially rear and fore end portions of the internal annular groove 23C, respectively. The fore end face 6D of the motor body 6 is positioned in the vicinity of the first arcuately protruding ridge portion 23D, while the rear end of the rotary atomizing head 28, which will be described hereinafter, is located in the vicinity of the second arcuately protruding ridge portion 23E. Surfaces of the first and second arcuately protruding ridge portions 23D and 23E have a radius of curvature r of approximately 5 mm to 25 mm, including arcuate coat films 25 and 26 which will be described below.

Indicated at 25 is a first arcuate coat film which is formed on the surface of the first arcuately protruding ridge portion 23D. Similarly to the arcuate coat film 16 in the first embodiment, this arcuate coat film 25 is formed of a synthetic resin material such as polyester, epoxy resin, fluorine resin or the like which has conducting fiber kneaded thereinto. The arcuate coat film 25 is extended into the internal annular groove 23C from a fore end portion of the air motor body 6 and electrically connected to the fore end face 6D of the air motor body 6.

Designated at 26 is a second arcuate coat film which is formed on the surface of the second arcuately protruding ridge portion 23E. Similarly to the first arcuate coat film 25, this second arcuate coat film 26 is formed of a synthetic resin material such as polyester, epoxy resin, fluorine resin or the like which has conductive fiber kneaded thereinto, and electrically connected to the motor body 6 through a power supply semi-conductive coat film 27 which will be described hereinafter. Besides, the arcuate coat film 26 is located in such small gap relation with the rear end of a rotary atomizing head 28, which will be described after, as to permit air discharge thereacross.

Denoted at 27 is a power supply semi-conductive coat film which is applied on the surface of the annular groove 23C of the motor support case 23. Similarly to the arcuate coat films 25 and 26, the power supply semi-conductive coat film 27 is formed of a synthetic resin material such as polyester, epoxy resin, fluorine resin or the like having conductive fiber kneaded thereinto, and arranged to cover substantially the entire inner peripheral surfaces of the annular groove 23C. Further, the power supply semi-conductive coat film 27 is held in contact with the arcuate coat films 25 and 26 at its opposite axial ends. Consequently, the power supply semi-conductive coat film 27 electrically connected to the air motor body 6 along with the arcuate coat films 25 and 26.

Indicated at 28 is a rotary atomizing head which is rotatably mounted on a fore end portion of the rotational shaft 9. This rotary atomizing head 28 is constituted by an atomizing head body 29 and a hub member 30.

In a substantially same manner as the atomizing head body 12 in the foregoing first embodiment, the atomizing head body 29 of this embodiment is provided with a bell cup portion 29A, a mounting portion 29B, an annular partition wall 29C, a paint spreading surface 29D, paint releasing edges 29E, a female screw portion 29F, and a stepped hub mount portion 29G, which are all formed of an insulating synthetic resin material. However, the atomizing head body 29 differs from the atomizing head body 12 of the first embodiment in that no limiter ring is attached to the rear end of the mounting portion 29B.

On the other hand, in a substantially same manner as the hub member 13 in the foregoing first embodiment, the hub member 30 of this embodiment is constituted by a circular disk portion 30A and a cylindrical body portion 30B, and bored with a large number of first and second hub holes 30C and 30D.

Indicated at 31 is an on-head semi-conductive coat film which is formed on outer peripheral surfaces of the atomizing head body 29. The on-head semi-conductive coat film 31 is formed in a substantially same manner as the on-head semi-conductive coat film 14 in the first embodiment, and applied on surfaces between the paint releasing edges 29E and the rear end of the mounting portion 29B of the atomizing head body 29.

At the rear end of the mounting portion 29B, the on-head semi-conductive coat film 31 is disposed in small gap relation with the second arcuate coat film 26. As a consequence, a high voltage which is applied to the air motor 5 is supplied to the second arcuate coat film 26 through the first arcuate coat film 25 and the power supply semi-conductive coat film 27, and at the same time supplied to the on-head semi-conductive coat film 31 by air discharge across the gap space between the on-head semi-conductive coat film 31 and the second arcuate coat film 26. Therefore, through the on-head semi-conductive coat film 31, a high voltage can be applied to paint particles which are released from the paint releasing edges 29E.

Further, resistance values of the first arcuate coat film 25, power supply semi-conductive coat film 27, second arcuate coat film 26 and on-head semi-conductive coat film 31 are preadjusted such that a resistance value between the fore end face 6D of the motor body 6 and the paint releasing edges 29E of the rotary atomizing head 28 falls in a range of from 20 MΩ to 100 MΩ.

The present embodiment, with the arrangements just described, can produce substantially the same operational effects as the foregoing first embodiment. Especially in this case, having the power supply semi-conductive coat film 27 formed on the inner periphery of the motor support case 23, the on-head semi-conductive coat film 31 can be located at a spaced position from the rotational shaft 9 because there is no necessity for contacting the on-head semi-conductive coat film 31 with the rotational shaft 9. Therefore, the rotary atomizing head 28 can be easily dismantled from the rotational shaft 9 to facilitate a washing operation or other jobs on the rotary atomizing head in maintenance and service.

Figure 6:
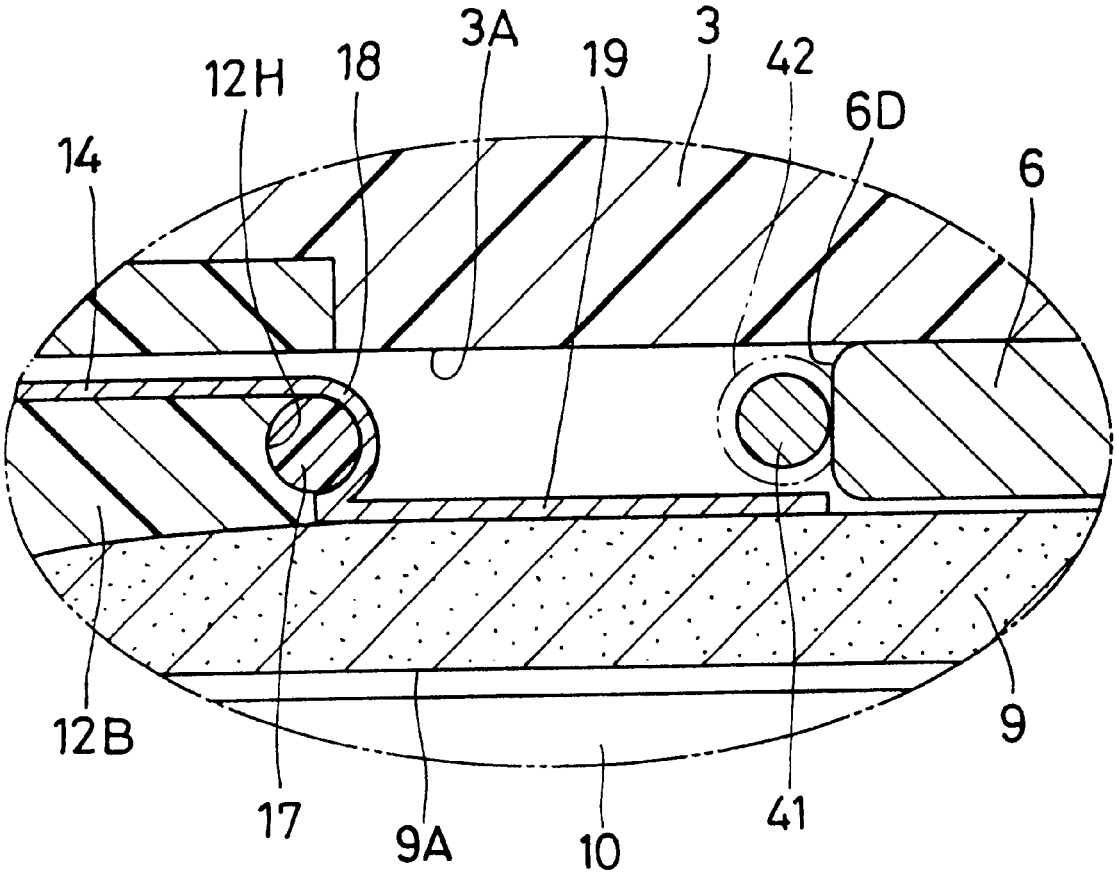
FIG. 6 is a schematic vertical section similar to FIG. 3, but showing on an enlarged first and second limiter rings employed in a third embodiment of the present invention.

Referring now to FIG. 6, there is shown a third embodiment of the present invention. This third embodiment has a feature in that, in place of the first limiter ring 15 and the first arcuate coat film 16 of the foregoing first embodiment, a first arcuately curved portion is formed by the use of a limiter ring of conductive metallic material. In the following description of the third embodiment, those component parts which are common with the foregoing first embodiment are designated by common reference numerals or characters to avoid repetitions of same explanations.

Indicated at 41 is a first limiter ring which is provided on the fore end face 6D of the motor body 6 as a first arcuately curved portion. This limiter ring 41 is formed in a circular ring-like shape in cross-section by the use of conductive metallic material. Further, the limiter ring 41 is provided in at a position intermediate between the power supply semi-conductive coat film 19 and the air motor 5, in such small gap relation with the rear end of the power supply semi-conductive coat film 19 as to permit air discharge across an intervening gap space. The surface of the first limiter ring 41 is formed to have a radius of curvature of approximately 0.5 mm to 25 mm.

The present embodiment, with the arrangements just described, can produce substantially the same operational effects as the foregoing first embodiment.

In this case, if desired, a first arcuate coat film 42 similar to the arcuate coat film 16 in the first embodiment may be provided on the outer peripheral surface of the limiter ring of conductive metallic material, as indicated by an imaginary line in FIG. 6.

Figure 7:
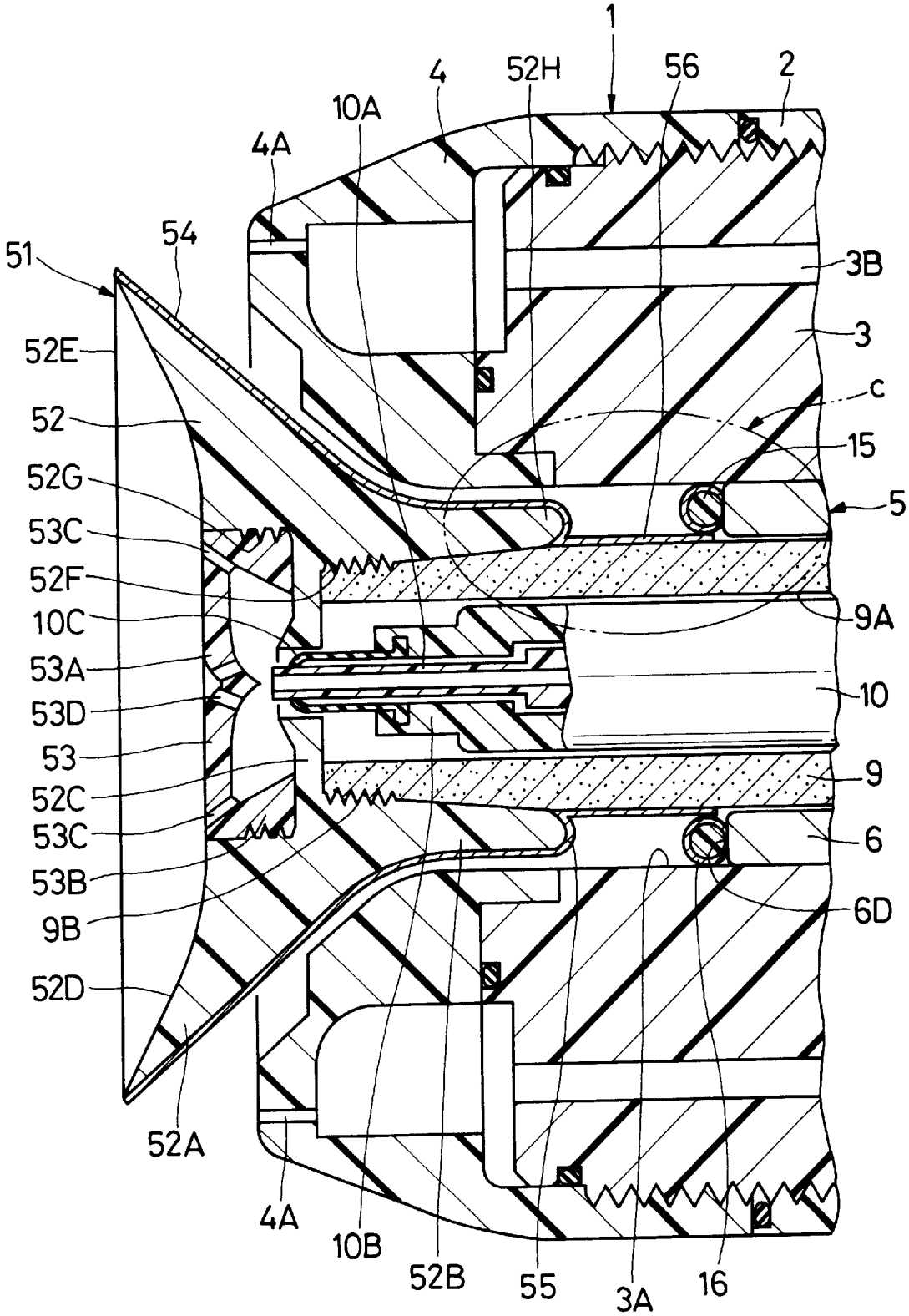
FIG. 7 is a schematic vertical section of a rotary atomizing head type coating machine adopted as a fourth embodiment of the present invention.
Figure 8:
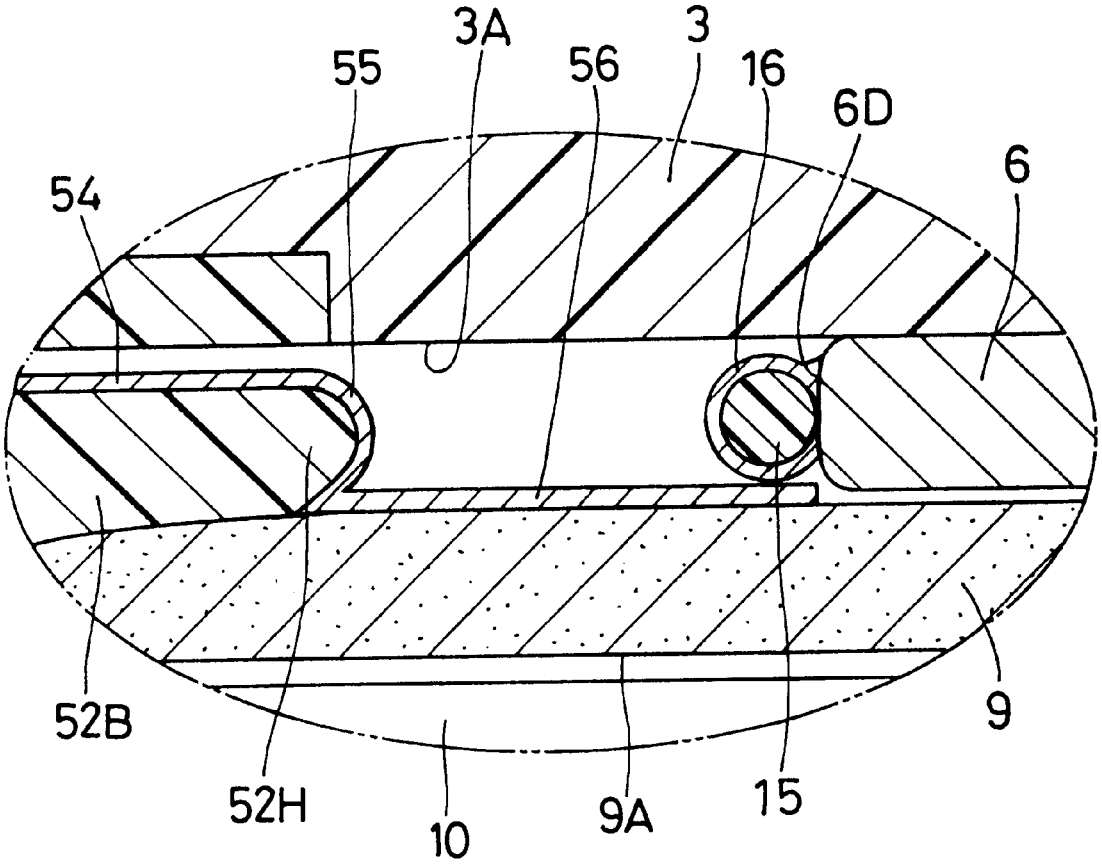
FIG. 8 is a schematic vertical section, showing on an enlarged scale an encircled portion c in FIG. 7.

Illustrated in FIGS. 7 and 8 is a fourth embodiment according to the present invention. This fourth embodiment has a feature in that, in place of the limiter ring 17 which is provided in the annular groove 12H in the first embodiment, the rear end of the rotary atomizing head is formed in an arcuate shape in section and a second arcuately curved portion is formed directly thereon. In the following description of the fourth embodiment, those component parts which are common with the foregoing first embodiment are designated by common reference numerals or characters to avoid repetitions of same explanations.

Indicated at 51 is a rotary atomizing head which is rotatably mounted on a fore end portion of the rotational shaft 9. Similarly, this atomizing head 51 is constituted by an atomizing head body 52 and a hub member 53.

Similarly to the atomizing head body 12 in the first embodiment, the atomizing head body 52 of this embodiment is formed of an insulating synthetic resin material, and constituted by a bell cup 52A, a mounting portion 52A, an annular partition wall 52C, a paint spreading surface 52D, paint releasing edges 62E, a female screw portion 52F, and a hub mounting portion 52G.

However, the atomizing head body 52 differs from the atomizing head body 12 of the first embodiment in that an arcuate end portion 52H of an arcuate shape in section is provided at the rear end of the mounting portion 52B to serve as a second arcuately curved portion. In this case, an arcuate coat film 55 is applied on circumferential surfaces of the arcuate end portion 52H as will be described hereinafter.

On the other hand, substantially in the same manner as the hub member 13 in the first embodiment, the hub member 53 is constituted by a circular disk portion 53A and a cylindrical body portion 53B, and bored with a large number of first and second hub holes 53C and 53D.

Denoted at 54 is an on-head semi-conductive coat film is which is applied in a film-like shape on outer peripheral surfaces of the rotary atomizing head 51. Similarly to the on-head semi-conductive coat film 14 in the first embodiment, the on-head semi-conductive coat film 54 of this embodiment is formed on circumferential surfaces between the rear end of the mounting portion 52B and the paint releasing edges 52E of the atomizing head body 52.

Indicated at 55 is a second arcuate coat film which is formed on circumferential surfaces of the arcuate end portion 52H. Substantially in the same manner as the on-head semi-conductive coat film 54, the arcuate coat film 55 is formed by a semi-conductive film, and located between and electrically connected with the on-head semi-conductive coat film 54 and a power supply semi-conductive coat film 56 which will be described hereinafter. Further, the arcuate end portion 52H is spaced from the limiter ring 15 by a gap space in the range of 10 mm to 80 mm, for example, by a gap space of 50 mm, and formed to have a radius of curvature in the range of 0.5 mm to 25 mm.

Indicated at 56 is a power supply semi-conductive coat film which is applied on outer peripheral surfaces of the rotational shaft 9. This power supply semi-conductive coat film 56 is in contact with the arcuate coat film 55 at its fore end, and has its rear end located in the vicinity of the fore end of the motor body 6. More specifically, the rear end of the power supply semi-conductive coat film 56 is located in such small gap relation with the fore end face 6D of the motor body 6 as to permit air discharge across an intervening gap space.

Thus, the present embodiment, with the arrangements just described, can produce substantially the same operational effects as the foregoing first embodiment. Especially in this case, having the second arcuate end portion 52H formed on the rotary atomizing head 51, it becomes possible to form the second arcuately curved portion during a fabrication process of the rotary atomizing head 51 and thus to reduce the number of steps of the fabrication process and to realize a cut in production cost.

In the first, third and fourth embodiments, a first arcuately curved portion is formed by the first limiter ring 15 or 31 which is provided on the fore end of the motor body 6. However, the fore end of the air motor may be directly formed into an arcuate shape if desired.

Further, in the second embodiment, the power supply semi-conductive coat film 27 is formed on inner surfaces of the motor support case 23. If desired, it is possible to is extend part of the shaping air ring as far as a position where the rotary atomizing head confronts face to face with the air motor and to provide the power supply semi-conductive coat film on the inner periphery of the shaping air ring.

INDUSTRIAL APPLICABILITY

As described in detail hereinbefore, according to the present invention, the coating machine employs a rotational shaft which is formed of an insulating material, so that it becomes possible to prevent occurrence of spark discharges between the rotational shaft and a coating object during coating operations even when the rotary atomizing head is moved to an abnormally close proximity to the coating object, guaranteeing safety and reliability in operation.

Further, a power supply semi-conductive coat film is provided either on inner peripheral surfaces of the cover or on outer peripheral surfaces of the rotational shaft, operatively in association with a first arcuately curved portion which is provided between a fore end portion of the air motor and the power supply semi-conductive coat film and a second arcuately curved portion which is provided between the power supply semi-conductive coat film and an on-head semi-conductive coat film formed on the rotary atomizing head. Therefore, it becomes possible to prevent occurrence of spark discharges between the fore end of the air motor and rear end of the rotary atomizing head even in case the rotary atomizing head is abruptly brought to the proximity to a coating object, thereby permitting to maintain high paint deposition efficiency along with enhanced operational safety.

Further, in a preferred form of the present invention, the rotational shaft is formed of insulating ceramic material, thereby preventing electrical discharges from the rotational shaft to a coating object during coating operations and at the same time permitting to enhance the strength and prevent deformations of the rotational shaft which is put in high speed rotation.

What is claimed is:

1. A rotary atomizing head type coating machine, comprising:

a cover of a tubular shape formed of an insulating synthetic resin material;

an air motor mounted within said cover and formed of a conducting metallic material;

a rotational shaft formed of an insulating material passed axially through and adapted to be rotated by said air motor;

a rotary atomizing head formed of an insulating synthetic resin material in a bell-like shape having a mounting portion at a rear end and paint releasing edges at a fore end thereof, and mounted on said rotational shaft at an axially spaced position from a fore end of said air motor;

an on-head semi-conductive coat film provided on outer peripheral surfaces of said rotary atomizing head for charging paint particles to be sprayed from said rotary atomizing head;

a power supply semi-conductive coat film provided either on inner peripheral surfaces of said cover or on outer peripheral surfaces of said rotational shaft between said fore end of said air motor and a rear end of said rotary atomizing head for supplying said rotary atomizing head with a high voltage applied to said air motor;

a first arcuately curved portion formed in a ring-like shape by the use of an insulating synthetic resin material applied with a semi-conductive coat film on outer peripheral surfaces thereof or by the use of a conducting metallic material, and provided between said fore end of said air motor and said power supply semi-conductive coat film; and a second arcuately curved portion formed in a ring-like shape by the use of an insulating synthetic resin material applied with a semi-conductive coat film on outer peripheral surfaces thereof or by the use of a conducting metallic material, and provided between said power supply semi-conductive coat film and a rear end of said on-head semi-conductive coat film.

2. A rotary atomizing head type coating machine as defined in claim 1, wherein said rotational shaft is formed of an insulating ceramic material.

3. A rotary atomizing head type coating machine as defined in claim 1, wherein said first and second arcuately curved portions are formed to have arcuately curved surfaces of from 0.5 mm to 25 mm in radius of curvature.

4. A rotary atomizing head type coating machine as defined in claim 1, wherein said first and second arcuately curved portions are spaced away from each other by a distance of from 10 mm to 80 mm.

5. A rotary atomizing head type coating machine as defined in claim 1, wherein said first arcuately curved portion is formed of an insulating synthetic resin material and applied with a semi-conductive coat film on outer peripheral surfaces thereof.

6. A rotary atomizing head type coating machine as defined in claim 1, wherein said second arcuately curved portion is formed of an insulating synthetic resin material and applied with a semi-conductive coat film on outer peripheral surfaces thereof.

7. A rotary atomizing head type coating machine as defined in claim 1, wherein said first arcuately curved portion is formed of a conducting metallic material.

8. A rotary atomizing head type coating machine as defined in claim 1, wherein said second arcuately curved portion is formed of a conducting metallic material.

9. A rotary atomizing head type coating machine as defined in claim 1, wherein said power supply semi-conductive coat film is applied on and around inner peripheral surfaces of said cover, and said first and second arcuately curved portions are formed of the same material as said cover and applied with a semi-conductive coat film on outer peripheral surfaces thereof.

10. A rotary atomizing head type coating machine, comprising:

a cover of a tubular shape formed of an insulating synthetic resin material;

an air motor mounted within said cover and formed of a conducting metallic material;

a rotational shaft of an insulating material passed axially through and adapted to be rotated by said air motor;

a rotary atomizing head formed of an insulating synthetic resin material in a bell-like shape having a mounting portion at a rear end and paint releasing edges at a fore end thereof, and mounted on said rotational shaft at an axially spaced position from a fore end of said air motor;

an on-head semi-conductive coat film provided on outer peripheral surfaces of said rotary atomizing head for charging paint particles to be sprayed from said rotary atomizing head;

a power supply semi-conductive coat film provided on outer peripheral surfaces of said rotational shaft between said fore end of said air motor and a rear end of said rotary to atomizing head for supplying said rotary atomizing head with a high voltage applied to said air motor;

a first arcuately curved portion formed in a ring-like shape by the use of an insulating synthetic resin material applied with a semi-conductive coat film on outer peripheral surfaces thereof or by the use of a conducting metallic material, and provided between said fore end of said air motor and said power supply semi-conductive coat film; and a second arcuately curved portion formed in a ring-like shape by the use of an insulating synthetic resin material applied with a semi-conductive coat film on outer peripheral surfaces thereof or by the use of a conducting metallic material, and provided between said power supply semi-conductive coat film and a rear end of said on-head semi-conductive coat film.

11. A rotary atomizing head type coating machine, comprising:

a cover of a tubular shape formed of an insulating synthetic resin material;

an air motor mounted within said cover and formed of a conducting metallic material;

a rotational shaft of an insulating material passed axially through and adapted to be rotated by said air motor;

a rotary atomizing head formed of an insulating synthetic resin material in a bell-like shape having a mounting portion at a rear end and paint releasing edges at a fore end thereof, and mounted on said rotational shaft at an axially spaced position from a fore end of said air motor;

an on-head semi-conductive coat film provided on outer peripheral surfaces of said rotary atomizing head for charging paint particles to be sprayed from said rotary atomizing head;

a power supply semi-conductive coat film provided on inner peripheral surfaces of said cover between said fore end of said air motor and a rear end of said rotary atomizing head for supplying said rotary atomizing head with a high voltage applied to said air motor;

a first arcuately curved portion formed in a ring-like shape by the use of an insulating synthetic resin material applied with a semi-conductive coat film on outer peripheral surfaces thereof or by the use of a conducting metallic material, and provided between said fore end of said air motor and said power supply semi-conductive coat film; and a second arcuately curved portion formed in a ring-like a shape by the use of an insulating synthetic resin material applied with a semi-conductive coat film on outer peripheral surfaces thereof or by the use of a conducting metallic material, and provided between said power supply semi-conductive coat film and a rear end of said on-head semi-conductive coat film.

* * * * *

UNITED STATES PATENT AND TRADEMARK OFFICE

CERTIFICATE OF CORRECTION

PATENT NO. : 6,230,994 B1
DATED : May 15, 2001
INVENTOR(S) : Boerner et al.

It is certified that error appears in the above-identified patent and that said Letters Patent is hereby corrected as shown below:

Title page,
Item [56], under References Cited, please add the following references:

| | | |
|---|---|---|
| -- 4,887,770 | 12/19/89 | R.L. Wacker et al; |
| 5,433,387 | 07/18/95 | V.E. Howe et al.; |
| 2-237667 | 09/20/90 | Japan; |
| 6-269701 | 09/27/94 | Japan; |
| 8-150352 | 06/11/96 | Japan --. |

Signed and Sealed this

Eleventh Day of December, 2001

*Attest:*

Nicholas P. Godici

*Attesting Officer*

NICHOLAS P. GODICI
*Acting Director of the United States Patent and Trademark Office*